US006685063B2

(12) United States Patent
Brugner

(10) Patent No.: US 6,685,063 B2
(45) Date of Patent: Feb. 3, 2004

(54) CARTRIDGE PLUNGER WITH GAS EVACUATION

(75) Inventor: Nikolaus Brugner, Ziemetshausen (DE)

(73) Assignee: Sulzer Chemitech AG, Winterthur (CH)

( * ) Notice: Subject to any disclaimer, the term of this patent is extended or adjusted under 35 U.S.C. 154(b) by 0 days.

(21) Appl. No.: 10/216,053

(22) Filed: Aug. 10, 2002

(65) Prior Publication Data

US 2003/0079798 A1 May 1, 2003

(30) Foreign Application Priority Data

Oct. 31, 2001 (DE) ..... 201 17 778 U

(51) Int. Cl.[7] ..... B05C 17/05
(52) U.S. Cl. ..... 222/387; 222/386.5; 222/327
(58) Field of Search ..... 222/325–327, 222/386–387

(56) References Cited

U.S. PATENT DOCUMENTS 3,138,303 A * 6/1964 Hoveland ..... 222/389
4,714,423 A * 12/1987 Hattori et al. ..... 425/376.1
4,750,647 A * 6/1988 Cohen ..... 222/386.5
4,819,836 A * 4/1989 Meckenstock ..... 222/386
4,951,848 A * 8/1990 Keller ..... 222/386
5,267,673 A * 12/1993 Crosnier et al. ..... 222/321.7
5,667,102 A * 9/1997 Keller ..... 222/95
5,878,922 A * 3/1999 Boring ..... 222/387
5,957,338 A * 9/1999 Lehmann ..... 222/184
5,971,225 A * 10/1999 Kapsa ..... 222/212
6,202,714 B1 * 3/2001 Wang ..... 141/329
6,234,360 B1 * 5/2001 Bockmann et al. ..... 222/327
6,322,482 B1 * 11/2001 Kim ..... 482/124

* cited by examiner

*Primary Examiner*—J. Casimer Jacyna
(74) *Attorney, Agent, or Firm*—Martin Fleit; Paul D. Bianco; Fleit Kain Gibbons Gutman Bongini & Bianco P.L..

(57) ABSTRACT

A cartridge plunger with at least one gas evacuation opening and at least one gas evacuation element covering the cartridge plunger opening. For a simple and dependable gas evacuation and to prevent any undesirable leakage of the filler material, the gas evacuation element is at least one cover disk that forms a labyrinth path running transverse to the plunger axis. The path is located between the contact surface of the cover disk facing the gas evacuation opening and a corresponding contact surface on the cartridge plunger.

9 Claims, 1 Drawing Sheet

CARTRIDGE PLUNGER WITH GAS EVACUATION

BACKGROUND OF THE INVENTION

1. Field of the Invention

The invention pertains to a cartridge plunger with at least one gas evacuation opening and at least one gas evacuation element covering the cartridge plunger opening.

2. Prior Art

A cartridge plunger of this kind is known from DE 298 00 594 U1. In this case, a gas evacuation hole in the plunger is covered by a filter element, designed as a micropore filter, which is installed in a pocket formed in the plunger. Due to this filter element, the air located in the cartridge between the plunger and the filler material can escape when the plunger is pressed into the cartridge, but any discharge of the filler material will be prevented. However, gas evacuation devices of this kind are only conditionally suitable for low-viscosity resins, since the resin can diffuse through the filter element during storage. Thus, the result may be undesirable leakage.

In addition, plungers with special gas evacuation valves are known, which are actuated by specially shaped plunger insertion pins when inserting the plunger into the cartridge. However, the manufacture of these plungers is rather complicated, and is thus associated with correspondingly greater expense. The valve technology is thus too expensive, especially for smaller and low-cost cartridges.

SUMMARY OF THE INVENTION

It is the purpose of the invention to create a simply-designed and low-cost cartridge plunger which will allow dependable gas evacuation and at the same time will prevent any undesirable leakage of the filler material.

This problem is solved by a cartridge plunger with at least one gas evacuation opening and at least one gas evacuation element covering the cartridge plunger opening that is characterized in that the gas evacuation element is at least one cover disk which forms a labyrinth path running transverse to the plunger axis and being located between the contact surface of the cover disk facing the gas evacuation opening and a corresponding contact surface on the cartridge plunger In a further refinement of the invention the cartridge plunger in that to form the labyrinth path, the contact surface of the cover disk and/or the contact surface on the cartridge plunger has a specified surface roughness. In a particular refinement, the contact surface of the cover disk and/or the contact surface on the cartridge plunger has a surface roughness between 10 and 50 $\mu$m.

According to the invention, the cartridge plunger can be characterized in that there is a recess to hold the cover disk located in the front surface facing the cartridge inside. Also, the contact surface can run conically inward in the direction of the gas evacuation opening.

Further, the cartridge plunger can be characterized in that at the upper edge of the recess can have an annular flange to provide a snap attachment of the cover disk within the recess. Also, the cover disk can be flexible. In addition, the cover disk can consist of a soft plastic.

The invention pertains to a cartridge plunger with at least one gas evacuation opening and at least one gas evacuation element covering the cartridge plunger opening. For a simple and dependable gas evacuation and to prevent any undesirable leakage of the filler material, the gas evacuation element is at least one cover disk which forms a labyrinth path running transverse to the plunger axis, said path being located between the contact surface of the cover disk facing the gas evacuation opening and a corresponding contact surface on the cartridge plunger.

The cartridge plunger according to this invention is characterized in that a labyrinth path is formed between the cover disk and the plunger, running transverse to the plunger axis, through which the air located between the plunger and the filler material can escape when pressing the plunger into the cartridge, but such that the filler material located in the cartridge will be held back.

In one particularly efficient embodiment of the invention relative to manufacturing engineering, a cover disk is used made of a soft plastic with a rough contact surface that comes to rest against a smooth contact surface of the plunger. Thus, in this simple manner a filter or labyrinth path is created between the rough contact surface of the cover disk and the smooth contact surface on the plunger.

However, in place of the rough contact surface of the cover disk, the contact surface on the plunger itself, or both the contact surface as well as the contact surface of cover disk and plunger, can also be designed as a rough surface.

The surface roughness can be adapted to particular requirements continuously and at low cost by selection of the particular material or by processing of the surface. For example, a surface roughness of 10 to 50 $\mu$m, preferably 30 $\mu$m, has proven to be particularly useful for resinous filler materials.

BRIEF DESCRIPTION OF THE DRAWINGS

Additional details and advantages of the invention are indicated from the following description of preferred embodiments, as presented in the figures. We have.

DETAILED DESCRIPTION OF PREFERRED SPECIFIC EMBODIMENTS

Figure 1:
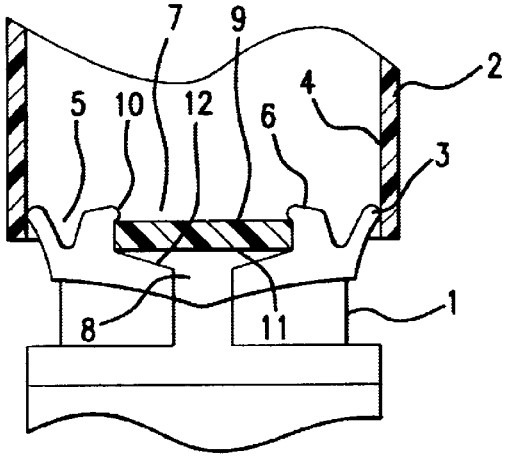
FIG. 1 shows a cartridge plunger with a cover disk in a closed position.

The plunger 1 shown in FIG. 1 is installed in the open end of a syringe or cartridge 2. The plunger 1 consists of a plastic and is manufactured as an injection molded article. At its radial outer side it has a perimeter sealing lip 3 that bears against the inside wall 4 of the cartridge 2. The elasticity of the sealing lip 3 is achieved by an annular groove 5 having a wedge-shape cross-section that is provided at the front side 6 of the plunger 1 facing the cartridge. At the front side 6 there is a central recess 7 and a gas evacuation opening 8 leads away from it to the outside. A cover disk 9 located above the gas evacuation opening 8 is installed in the recess 7. The recess 7 has at its upper edge an inward-pointing annular bead 10, by means of which the cover disk 9 (made of a soft plastic) is clamped inside the recess 7 with a slight under-cut.

The flexible cover disk 9 is made of soft plastic and has, on the side facing the gas evacuation opening 8, a rough contact surface 11 with a roughness chosen according to the particular requirements. Between the rough contact surface 11 and a smooth contact 12 on the plunger 1 there is a filter path or labyrinth path 13 (shown in FIG. 2) through which the air located between the plunger 1 and the filler material can escape when pressing the plunger 1 into the cartridge 2, but such that any discharge of the filler material present in the cartridge 2 will be prevented.

Figure 4:
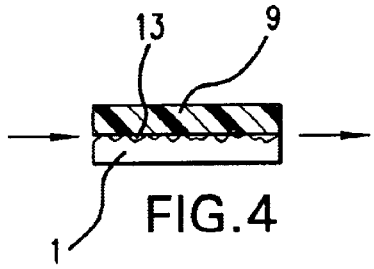
FIG. 4 shows a filter path between a smooth and a rough surface.
Figure 5:
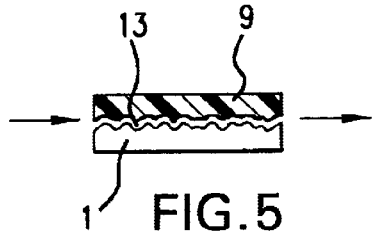
FIG. 5 shows a filter path between two rough surfaces.

According to FIG. 4, the labyrinth path 13 can also be formed between the cover disk 9 and the plunger 1 by designing the contact surface 11 of the cover disk 9 to be smooth, and the contact surface 12 of the plunger 1 to be rough. In addition, however, both the contact surface 11 of the cover disk 9 as well as the contact surface 12 of the plunger 1 can be rough, as is shown in FIG. 5. Depending on the filler material located in the cartridge 2, the labyrinth-like gap seal can be adapted to the particular requirements by an appropriate selection of the material and/or by processing of the surface.

Figure 2:
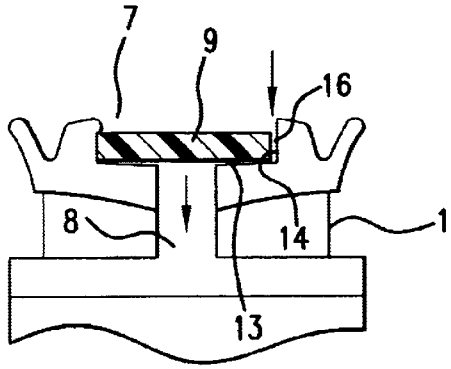
FIG. 2 shows a cartridge plunger with a cover disk in a gas evacuation position.

In the design illustrated in FIGS. 1 and 2, the contact surface 12 of the plunger 1 within the recess 7 has a slightly conical shape, as a kind of flat funnel inclined inward in the direction of the gas evacuation opening 8, so that the cover disk 9, when not in the stressed state, will rest within the recess 7 only at its edge, and seal only at the edge against the plunger 1. But when the cover disk 9 is exposed to pressure from the inside of the plunger, as will occur when pressing the plunger 1 into the cartridge 2, then in this design the cover disk 9 (produced as a flexible plastic disk) will bend inward, so that then an annular gap 15 will be produced between the edge of the cover disk 9 and the side wall 14 of the recess. The air can then escape through the annular gap 15 and the labyrinth path 13 formed by the roughness, so that the filler material will be held back by appropriate selection of the roughness.

Figure 3:
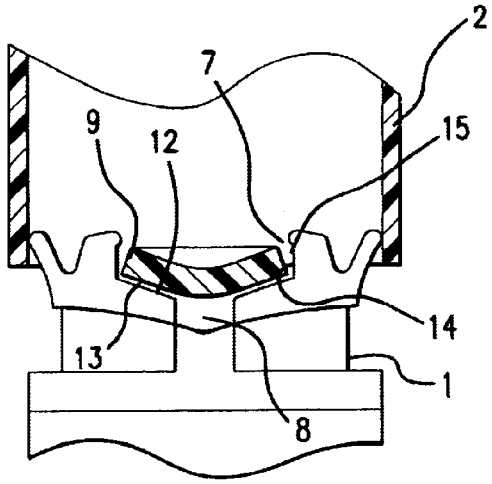
FIG. 3 shows a cartridge plunger with a cover disk in a second design embodiment.

As is indicated in FIG. 3, however, one could provide a gap-shaped passage 16 between the side wall 14 of the recess 7 and the outside of the cover disk 9 at least on one side of the cover disk. This passage can also be created by several gap-like grooves distributed along the perimeter on the radial exterior of the cover disk 9 and/or in the side wall 14 of the recess 7. In this case, no flexure of the cover disk 9 is needed, and the contact surface 12 on the plunger 1 can be made flat.

The invention is not limited solely to the embodiments described above and illustrated in the figures. For instance, the labyrinth path formed between the cover disk and the plunger can also be created by specifically installed labyrinth-like recesses at the contact surface of the cover disk and/or on the contact surface of the plunger. The invention is intended for use in a double syringe, but is also suitable for use in all cartridges (single- and multiple-component cartridges and syringes).

Although the invention has been shown and described in detail, nevertheless changes and modifications are possible which will be apparent to those skilled in the art without departing from the spirit, scope and contemplation of the invention as taught herein. Such changes and modifications are deemed to fall within the purview of the invention.

What is claimed is:

1. In a cartridge plunger with at least one gas evacuation opening and at least one gas evacuation element covering the cartridge plunger opening the improvement comprising the gas evacuation element being comprised of at least one cover disk which forms a labyrinth path running transverse to the plunger axis and located between a contact surface of the cover disk facing the gas evacuation opening and a corresponding contact surface on the cartridge plunger.

2. In a cartridge plunger according to claim 1, the further improvement of the labyrinth path and the contact surface of the cover disk having a specified surface roughness.

3. In a cartridge plunger according to claim 1, the further improvement of the contact surface on the cartridge plunger having a specified surface roughness.

4. In a cartridge plunger according to claim 1, the further improvement of at least one of the contact surface of the cover disk and the contact surface on the cartridge plunger having a surface roughness between 10 and 50 um.

5. In a cartridge plunger according to claim 1, the further improvement of a recess to hold the cover disk located in a front surface facing the cartridge inside.

6. In a cartridge plunger according to claim 1, the further improvement of the contact surface running conically inward in the direction of the gas evacuation opening.

7. In a cartridge plunger according to claim 1, the further improvement of the plunger having a recess formed with an upper edge of the recess as an annular flange to provide a snap attachment of the cover disk within the recess.

8. In a cartridge plunger according to claim 1, the further improvement of the cover disk being flexible.

9. In a cartridge plunger according to claim 1, the further improvement of the cover disk being comprised of a soft plastic.

* * * * *

UNITED STATES PATENT AND TRADEMARK OFFICE

CERTIFICATE OF CORRECTION

PATENT NO. : 6,685,063 B2
DATED : February 3, 2004
INVENTOR(S) : Nikolaus Brugner It is certified that error appears in the above-identified patent and that said Letters Patent is hereby corrected as shown below:

Title page,
Item [73], Assignee, please change the following:
-- [73] Assignee: Sulzer Chemtech AG, Winterthur (CH) --

Signed and Sealed this

Eighteenth Day of May, 2004

JON W. DUDAS
*Acting Director of the United States Patent and Trademark Office*